United States Patent [19]

Moriyama

[11] Patent Number: 4,760,781

[45] Date of Patent: Aug. 2, 1988

[54] OVERLOAD PROTECTING APPARATUS FOR A PRESS

[75] Inventor: Hidemi Moriyama, Komatsu, Japan

[73] Assignee: Kabushiki Kaisha Komatsu Seisakusho, Tokyo, Japan

[21] Appl. No.: 942,686

[22] Filed: Dec. 17, 1986

[30] Foreign Application Priority Data

Dec. 26, 1985 [JP] Japan ..... 60-292126

[51] Int. Cl.[4] ..... B30B 15/16; B30B 15/28

[52] U.S. Cl. ..... 100/53

[58] Field of Search ..... 100/48, 269 R, 53, 258 R, 100/901; 72/1, 20, 453.01; 192/129 A

[56] References Cited

U.S. PATENT DOCUMENTS

| | | | |
|---|---|---|---|
| 4,030,336 | 6/1977 | Grigonenko et al. | 100/53 X |
| 4,166,415 | 9/1979 | Spanke et al. | 100/53 |
| 4,492,154 | 1/1985 | Rupp et al. | 100/53 |
| 4,593,547 | 6/1986 | Heiberger | 72/1 |

FOREIGN PATENT DOCUMENTS

| | | |
|---|---|---|
| 42-14430 | 8/1967 | Japan . |
| 53-34666 | 9/1978 | Japan . |
| 59-33480 | 8/1984 | Japan . |
| 61-83000 | 6/1986 | Japan . |
| 61-111700 | 7/1986 | Japan . |

*Primary Examiner*—Andrew M. Falik

*Attorney, Agent, or Firm*—Finnegan, Henderson, Farabow, Garrett and Dunner

[57] ABSTRACT

An overload protection apparatus for a press having a plurality of slide points for supporting a slide of the press, and a plurality of oil chambers in which pressure is generated in proportion to the pressure applied to the slide. The oil chambers are preferably provided at said slide points. A protector valve having an oil chamber is in flow communication with each of the oil chambers of the slide points via passages. Logic valves are disposed in the passages between the oil chambers of the slide points and the oil chamber of the protector valve for preventing working fluid, such as oil, from flowing from the oil chamber of the protector valve to the oil chambers of said slide points. Preferably, pressure sensors are provided at each oil chamber of the slide points for detecting the pressure of the oil in the chambers of the slide points.

7 Claims, 2 Drawing Sheets

OVERLOAD PROTECTING APPARATUS FOR A PRESS

BACKGROUND OF THE INVENTION

1. Field of the Invention

This invention relates to an overload protecting apparatus for protecting a press from damage to the members thereof caused by an overload.

2. Description of the Prior Art

Generally speaking, in a mechanical press, the pressure generated around the lower dead center of a slide is so high that the members of the press are likely to be damaged when the pressure exceeds a nominal pressure equal to a maximum pressure which the members of the press can stand. In order to protect the members of the press from such damage, the mechanical press is provided with an overload protecting apparatus.

FIG. 1 is a system diagram showing a conventional hydraulic type overload protecting apparatus for a press. The overload protection apparatus is conventionally provided at a slide point where connecting rods are connected to a slide 1. Slide 1 represents, by way of example, a top press plate of the press.

More particularly, the apparatus comprises pistons 52 and 53 connected to piston rods 16 and 17 which are connected to connecting rods 50 and 51; and oil chambers 4 and 5. Chambers 4 and 5 are disposed at slide points 2 and 3 where a slide 1 is connected to piston rods 16 and 17 and thereby connecting rods 50 and 51 for moving the slide, or top press plate, of the press up and down. The pressure in the oil chambers is varied by movement of the pistons 52 and 53 so as to be in proportion to the load applied on the slide 1. The apparatus further includes a protector valve 8, having an oil chamber 6 in communication with the oil chambers 4 and 5. Working fluid, such as oil, in the oil chambers 4 and 5 is discharged via the oil chamber 6 to a drain 7 when the pressure of the oil in the oil chamber 6 exceeds a predetermined level. The protector valve 8 comprises a piston 9, the oil chamber 6 and an air chamber 10, the piston 9 partioning the protector valve 8 into the latter two. Air supplied from an air supply source (not shown) keeps the pressure inside the air chamber 10 at a predetermined level, thereby providing a constant upward force on the piston 9.

In the conventional overload protecting apparatus shown in FIG. 1, when overload is applied on the slide 1 so that the pressure of at least one of the oil chambers 4 and 5 exceeds the pressure of the protector valve 8 (i.e. the air pressure in the air chamber 10), the piston 9 of the valve 8 is lowered so as to communicate the oil chamber 6 with the drain 7, thereby discharging the oil in the oil chambers 4 and 5 into the drain 7. As a result, pistons 52 and 53 at the slide points 2 and 3 move closer to the slide 1, thereby releasing the overload. An oil pump 11 is provided for pumping oil via the solenoid valve 12 into the oil chambers 4 and 5, whereby in a normal state the pressure of the oil in chambers 4 and 5 is always pushing the slide 1 downwardly in FIG. 1 against the force of a balance cylinder (not shown). A relief valve 13 keeps the pressure of the oil pumped by the oil pump 11 at a predetermined level.

The numeral 14 in FIG. 1 designates a limit switch operated by the piston 9 of the protector valve 8 for protecting an overload operation. When the piston 9 of the protector valve 8 is raised, the limit switch 14 is activated to connect a power source to a solenoid 15 of the solenoid valve 12, thereby setting the solenoid valve 12 in the position to supply oil into the oil chambers 4 and 5. When the piston 9 of the protector valve 8 is lowered, the limit switch 14 disconnects the power source to solenoid 15 so as to demagnetize the solenoid 15, thereby setting the solenoid valve 12 in the position suitable for drainage so as to shut off the supply of the working oil into the oil chambers 4 and 5.

Incidentally, in the press comprising the overload protecting apparatus, causes generating the overload are removed after the overload is released by means of the overload protecting apparatus. Consequently, a reset switch, not shown, is turned on so as to excite the solenoid 15 of the solenoid valve 12, thereby setting the solenoid valve 12 in the position suitable for supplying the oil to chambers 4 and 5 in the normal state. Each base of the piston rods 16 and 17 is threaded for attachment to the piston 52 and 53 for adjusting their slide distance.

During the operation of a press, when an unbalanced load is applied on the slide 1, the slide 1 inclines, thereby decreasing accuracy of pressing operation and shortening the life spans of the upper mold and the lower mold of the press. In order to prevent the foregoing, when an unbalanced load is applied on the slide 1, it is necessary to detect the unbalanced load and to remove the causes thereof. However, the conventional overload protecting apparatus is so constructed that the oil chambers 4 and 5 are directly communicated with each other via the oil chamber 6 provided in the protector valve 8. Accordingly, even when an unbalanced load is applied, the pressures of both chambers come to the same level. Therefore, even though the pressures applied inside the oil chambers 4 and 5 are detected, it is impossible for the conventional type of overload protecting apparatus to detect an unbalanced load applied on slide 1.

Furthermore, the pressure of the air pumped into the air chamber 10 pushes up the piston 9 of the protector valve 8 in the conventional overload protecting apparatus. Accordingly, even when an overload is applied on the slide 1 and the pressure applied inside the oil chamber 6 pushes down the piston 9 of the protector valve 8, the piston 9 is not lowered down to the stroke end. As a result, all the working oil pumped into the oil pressure chambers 4 and 5 is not discharged into the drain 7. When an object to be pressed is sufficiently thick and is placed between the upper mold and the lower mold and an overload occurs, there is a possibility that the slide 1 cannot be raised up to the height suitable for removing the object.

Examples of the previously described conventional overload protecting apparatus are disclosed in Japanese Patent Laid-open Nos. 54-55874, 61-83000; Utility Model Laid-open No. 61-111700; and Patent Application Publication Nos. 42-12230, 53-34666, 59-33480. Each of these apparatus suffer the drawback noted above where an unbalanced load applied on a slide cannot be detected.

SUMMARY OF THE INVENTION

An object of the present invention is to provide an overload protecting apparatus for a press capable of detecting an unbalanced load applied on a slide so as to enhance the accuracy of the pressing operation and to prolong the lives of the upper mold and the lower mold of the press.

Another object of this invention is to provide an overload protecting apparatus for a press capable of assuring an upward stroke of the slide sufficient to remove the object to be pressed which is placed between the upper mold and the lower mold of the press when an overload occurs.

A further object of this invention is to provide an overload protecting apparatus for a press capable of decreasing consumption of the electric power for the solenoid valve.

According to this invention, there is provided an overload protecting apparatus for a press having a plurality of slide points for supporting a slide of the press, oil chambers in which pressure is generated in proportion to pressure applied to the slide, said oil chambers being provided in said slide points, and a protector valve whose oil chamber is communicated with each of said oil chamber of the slide points via passages wherein logic valves are provided between said oil chambers of said slide points and said oil chamber of said protector valve for preventing working fluid, such as oil, from flowing from said oil chamber of said protector valve to said oil chambers of said slide points, and pressure sensors provided at each oil chamber of said slide points for detecting oil pressure of said oil chambers of said slide points.

The following detailed description and the attached drawings will sufficiently show the other objects and effects of this invention.

DETAILED DESCRIPTION OF THE PREFERRED EMBODIMENT

Figure 1:
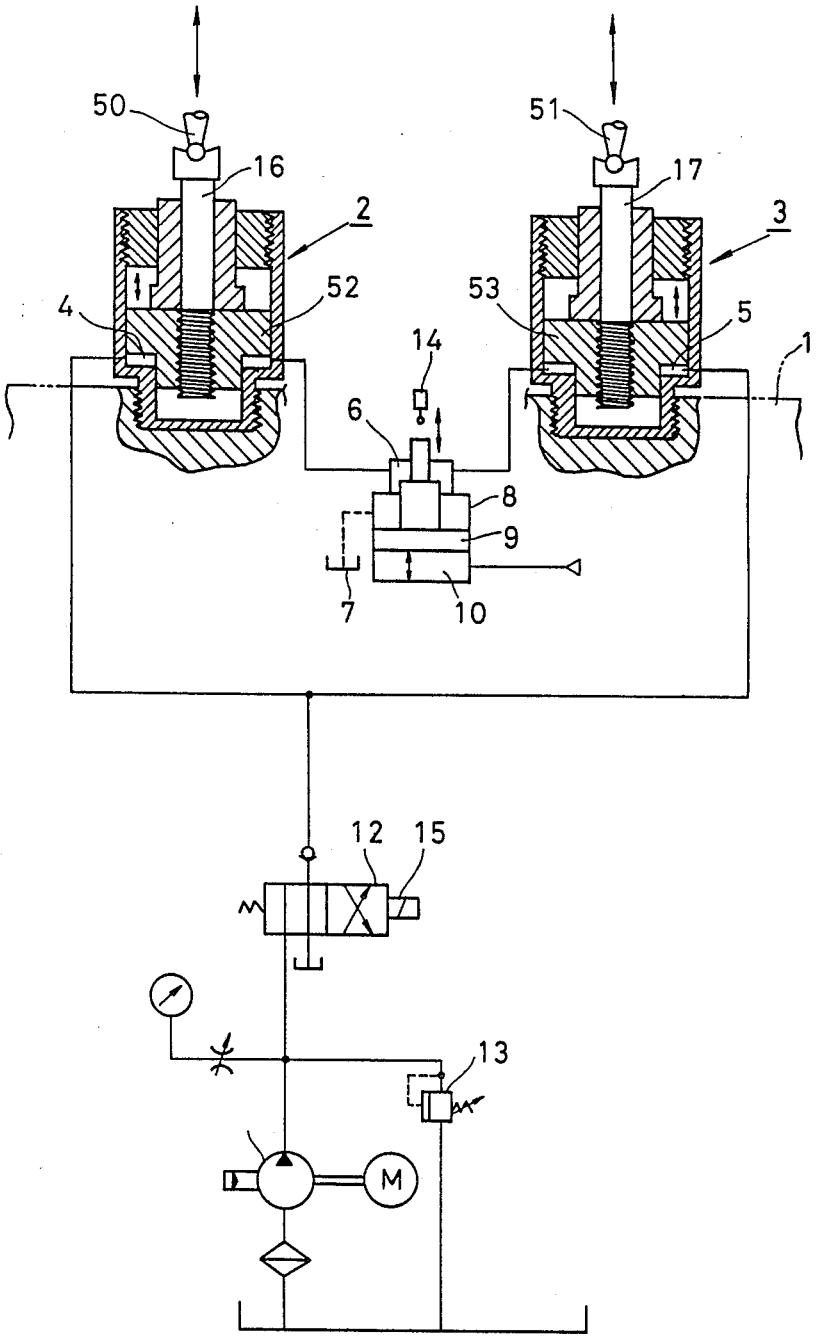
FIG. 1 PRIOR ART
FIG. 1 is a system diagram showing a conventional overload protecting apparatus for a press.
Figure 2:
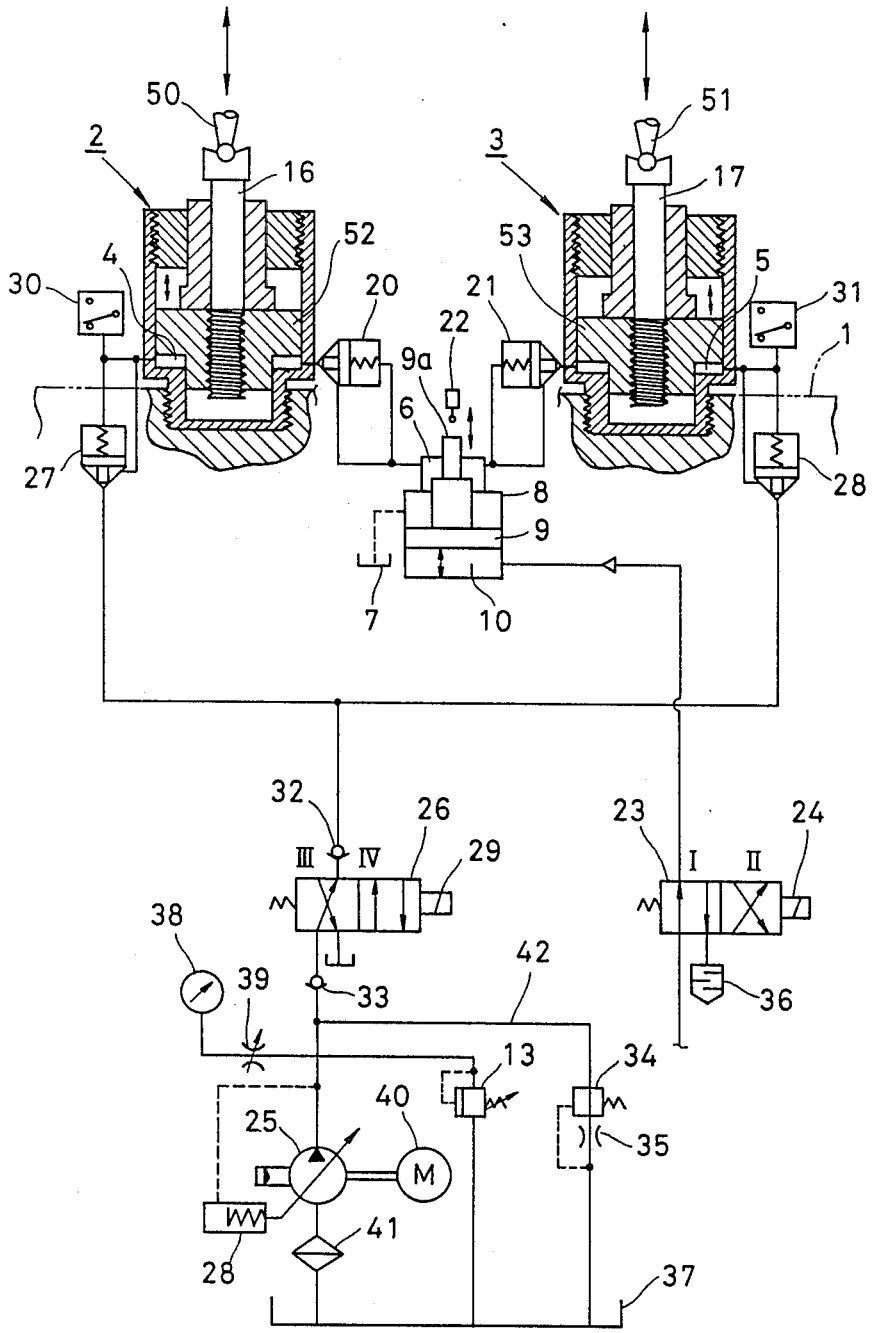
FIG. 2 is a system diagram showing an overload protecting apparatus for a press according to this invention.

Referring to FIG. 2, in which the same members as FIG. 1 are designated by the same numerals, a slide 1 is fixedly connected with connecting rods 50 and 51 at a pair of slide points 2 and 3, in which there are formed oil chambers 4 and 5 defined by pistons 52 and 53 and the side walls of respective slide points 2 and 3, in which a pressure in proportion to the load applied to the slide 1 is generated as the connecting rods 50 and 51 and pistons 52 and 53 are moved vertically as shown by the arrows in FIG. 2. Slide 1, by way of example, may be the top press plate of the press, or alternatively, may be an intermediate member placed between the top press plate and slide points 2 and 3. The oil chambers 4 and 5 are communicated with an oil chamber 6 in a protector valve 8 via logic valves 20 and 21 respectively. By way of example and not limitation, logic valves 20 and 21 may be conventional spring loaded check valves or relief valves which are operable to pass fluid therethrough in one direction upon sensing a sufficient pressure upstream to overcome the spring force of the valve thereby unseating the valve to allow passage of fluid. The logic valves 20 and 21 prevent working fluid, such as oil from flowing from the oil chamber 6 in the protector valve 8 into the oil chamber 4 and 5 in the slide points 2 and 3. By providing the logic valves 20 and 21 respectively on the oil passages between the oil chamber 6 and the oil chambers 4 and 5 in the slide points 2 and 3, pressure generated in each oil chamber 4 and 5 in the slide points 2 and 3 is transmitted to the oil chamber 6 in the protector valve 8, but is not transmitted to the other oil chamber 4 or 5 of the slide points 2 and 3. In other words, the pressure generated in each oil chamber 4 and 5 is not influenced by the pressure generated in the other oil chamber 4 or 5.

On the other hand, an air chamber 10 of the protector valve 8 is communicated with an air supply source (not shown) via a solenoid valve 23 driven by a limit switch 22 for ceasing load application. A limit switch 22 is operated by the piston 9 of the protector valve 8. When the switch 22 touches the top 9*a* of the piston 9, electric power is ceased being supplied to the solenoid valve 23. When top 9*a* is detached from switch 22, a signal is sent out to a sequencer (not shown) so that the electric power supply to the solenoid valve 23 is maintained by means of the signal from the sequencer. The solenoid valve 23 is a valve for selectively connecting the air chamber 10 of the protector valve 8 with the air supplying source or with the surrounding atmosphere. A solenoid 24 of the solenoid valve 23 is usually demagnetized by the limit switch 22 when overload is detected, and maintained at a position I where the air supplying source is connected with the air chamber 10. When the solenoid 24 is magnetized, by the signal from the limit switch 22, the solenoid 24 stops is maintained at a position II where the air chamber 10 is communicated with the atmosphere.

In the overload protecting apparatus, the oil is pressurized by an oil pump 25. Oil is supplied from pump 25 via a solenoid valve 26 and logic valves 27 and 28 to the oil chambers 4 and 5 of the slide points 2 and 3. Logic valves 27 and 28 are preferably spring-loaded one-way check or relief valves of the same type as logic valves 20 and 21. The oil pump 25 is of the type in which the discharging amount may be varied. The discharging amount from the oil pump 25 is controlled by a discharging amount control means 25*a* to a predetermined amount actuated by the pilot pressure of the oil pump 25. The solenoid valve 26 is driven by the limit switch 22. The solenoid 29 of the solenoid valve 26 is usually demagnetized by the limit switch 22 and maintained at a position III where the oil from oil pump 25 is supplied into the oil chambers 4 and 5. When the solenoid 29 is magnetized by the limit switch 22, the solenoid 29 stops at a position IV where the oil from oil pump 25 is drained in case of overload. The logic valves 27 and 28 prevent the oil from flowing in the opposite direction, that is, from the oil chambers 4 and 5 to the solenoid valve 26. A pressure gauge 30, for measuring the oil pressure in the oil pressure chamber 4, is provided at the passage extending between the logic valve 27 and the oil chamber 4, and a pressure gauge 31, for measuring the oil pressure in the oil chamber 5, is provided on the oil passage extending between the logic valve 28 and the oil chamber 5. In FIG. 2, numerals 32 and 33 designate check valves, 34 designates a relief valve, 35 designates a fixed throttle valve, 36 designates a silencer, 37 designates a drain line, 38 designates a pressure gauge, 39 designates a variable throttling valve, 40 designates a motor for driving the oil pump 25, and 41 designates a filter.

The function of the overload protecting apparatus will be described hereinafter.

When a press is operated with no overload application, the limit switch 22 for ceasing overload application touches the top 9*a* of the piston 9 of the protector valve 8, and no electric power is supplied to the solenoid valves 23 and 26. When the electric power source is turned OFF by means of the limit switch 22, the solenoids 24 and 29 of the solenoid valves 23 and 26 are demagnetized and remain at the positions I and III, respectively, so that oil from oil pump 25 is supplied to the oil pressure chambers 4 and 5 in the slide points 2 and 3, and the air of the air supplying source is supplied to the air chamber 10. When an overload is applied on the slide 1 so that the oil pressures in the oil chambers 4 and 5 exceed the predetermined pressure of the air supplied into the air chamber 10 in the protector valve 8, the pressures in the oil chamber 6 in the protector valve 8 and in the air chamber 10 are unbalanced, thereby pushing down the piston 9 of the protector valve 8. Since the oil chamber 6 in the valve 8 and the drain 7 are communicated with each other, when the piston 9 of the protector valve 8 is pushed down the oil supplied into the oil chambers 4 and 5 in the slide points 2 and 3 is discharged via the oil chamber 6 in the protector valve 8 into the drain 7 so that the slide 1 moves closer to pistons 52 and 53 of the slide points 2 and 3, thereby releasing the overload.

Since electricity is supplied when the piston 9 of the protector valve 8 is pushed down so that the top 9*a* of the piston 9 is detached from the limit swich 22, the solenoids 24 and 29 of the solenoid valves 23 and 26 are excited so that the solenoids 24 and 29 are shifted up to the positions II and IV, respectively, and remain there. Accordingly, the supply of oil into the oil chambers 4 and 5 is shut off and the air chamber 10 in the protector valve 8 is communicated with the atmosphere via the silencer 36 so that the air supplied into the air chamber is completely discharged. When all the air in the air chamber 10 is discharged, the pressure applied on the oil chamber pushes the piston 9 of the protector valve 8 down to the stroke end, thereby discharging the oil in the oil chambers 4 and 5 of the slide 1 into the drain 7. Accordingly, the slide 1 can move upward in FIG. 2 high enough for the object to be pressed or a pressed product placed between the upper and lower molds to be easily removed.

Further, since the logic valves 20 and 21 in the overload protecting apparatus according to this invention prevent the pressure interference between the chambers 4 and 5 of the slide points 2 and 3, pressure gauges 30 and 31 detect different values when an unbalanced load is applied on the slide 1. Accordingly, whether or not an unbalanced load is applied on the slide 1 can be detected by comparing the values detected by the pressure gauges 30 and 31.

In the overload protecting apparatus according to this invention, when the overload has been released, the slide 1 moves upward so as to remove the causes generating overload after the overload is released. Subsequently, the solenoids 24 and 29 of the solenoid valves 23 and 26 are demagnetized so that the solenoids 24 and 29 are raised up to the positions I and III, respectively, so as to restore the normal state of the overload protecting apparatus.

Since the solenoid valves 23 and 26 are demagnetized under the normal state in the overload protecting apparatus according to this invention, such disadvantages as burning of coils in the solenoid valves rarely happens. Furthermore, since the electric power for driving the solenoid valve is not consumed in the normal state, the consumption of electric power for driving the whole apparatus is small.

In the overload protecting apparatus according to this invention, since the oil pump 25 is of the variable discharging amount type in which the discharging amount is controlled by a spring 50 of discharging amount control member 25 which biases control member 25*a* toward a position of maximum flow through pump 25. When overload is applied is applied to the slide 1, the discharging pressure of the oil pump 25 increases. The increased discharging pressure in turn acts on a piston 25*b* which is connected to the spring 50 to cause the piston 25*b* to move to the left in FIG. 2 so that the discharging amount of the pump 25 decreases. Therefore, the oil is prevented from being vainly relieved. Furthermore, since the discharging pressure is made zero after the overload is released, the discharging amount of the oil pump 25 becomes maximum, thereby enabling pressurization of the oil in the pressure chambers 4 and 5 promptly.

In the overload protecting apparatus, since an oil passage 42 is provided with a relief valve 34 and a throttle valve 35, even though air is present in the oil passage 42, in such a case that, for example, the apparatus is operated immediately after it is assembled, the air is discharged through the relief valve 34 and throttle valve 35 into the drain 37, thereby preventing the air from adversely affecting the initial operation of the apparatus.

Furthermore, in the apparatus according to this invention, since the check valve 33 prevents the pressure of oil in the passage positioned in the upper stream of the check valve 33 from being lowered when the oil pump 25 is stopped, the oil in the oil passage does not flow in the opposite direction at the time of stoppage of the pump, thereby preventing reverse rotation or operation of the oil pump 25 so as to prevent useless operation of the apparatus.

While the present invention has been described above with respect to several preferred embodiments thereof, it should of course be understood that the invention may be embodied in other specific forms without any departure from the spirit or essential characteristics thereof. The above-described embodiments are therefore to be considered in all respects as illustrative and not limitive of the appended claims. Further, all changes which come within the meaning and the range of equivalency of the appended claims are intended to be embraced therein.

What is claimed is:

1. An overload protection apparatus for a press having a plurality of slide points for supporting a slide of the press and means for moving said slide relative to said slide points to apply pressure in said press, each said slide point having at least one working fluid chamber in which pressure is generated in proportion to the pressure applied by said press as said slide is moved relative to said slide points, and a protector valve having a piston dividing said protector valve into a first working fluid chamber which is in communication with each of said working fluid chambers of said slide points through respective passages and a second working fluid chamber which is in communication with a compressed air source, said overload protection apparatus further comprising:

logic valve means disposed in said passages between said working fluid chambers of said slide points and said first working fluid chamber of said protector valve for preventing working fluid from flowing from said first working fluid chamber of said protector valve to said working fluid chambers of said slide points; and pressure sensor means provided at each chamber of said slide points for detecting the pressure of the working fluid in said chambers of said slide points.

2. The overload protection apparatus for a press according to claim 1, including pump means for delivering working fluid at a predetermined pressure, via a solenoid valve, to said chambers of said slide points.

3. The overload protection apparatus for a press according to claim 2, wherein said solenoid valve includes a solenoid for controlling actuation of said solenoid valve such that working fluid is delivered to said chambers of said slide points from said pump means when said solenoid is demagnetized, and working fluid delivery to said chambers of said slide points is shut off when said solenoid is magnetized.

4. The overload protection apparatus for a press according to claim 2 further comprising a check valve provided in a passage configured between said pump means and said solenoid valve for preventing the working fluid from flowing from said solenoid valve to said pump means.

5. The overload protection apparatus of claim 2, including means for controlling the volume of working fluid displaced by said pump means in accordance with the working fluid pressure at the outlet of said pump means.

6. The overload protection apparatus for a press according to claim 1 further comprising a second solenoid valve means for selectively communicating said compressed air source with the surrounding atmosphere, said second solenoid valve means being interposed between said second chamber of said protector valve and said compressed air source.

7. The overload protection apparatus for a press according to claim 6, wherein said second solenoid valve means includes a second solenoid for actuating said second solenoid valve means such that said second chamber of said protector valve is in communication with said compressed air source when said second solenoid is demagnetized, and said second chamber is in communication with the atmosphere when said second solenoid is magnetized.

* * * * *